US010210974B2

(12) United States Patent
Ohkubo et al.

(10) Patent No.: US 10,210,974 B2
(45) Date of Patent: Feb. 19, 2019

(54) COIL COMPONENT WITH COVERING RESIN HAVING MULTIPLE KINDS OF METAL POWDERS

(71) Applicant: TDK CORPORATION, Tokyo (JP)

(72) Inventors: Hitoshi Ohkubo, Tokyo (JP); Masazumi Arata, Tokyo (JP); Manabu Ohta, Tokyo (JP); Shou Kawadahara, Tokyo (JP); Yoshihiro Maeda, Tokyo (JP); Takahiro Kawahara, Tokyo (JP); Hokuto Eda, Tokyo (JP); Shigeki Sato, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/952,028

(22) Filed: Nov. 25, 2015

(65) Prior Publication Data

US 2016/0155550 A1 Jun. 2, 2016

(30) Foreign Application Priority Data

Nov. 28, 2014 (JP) ..... 2014-241984

(51) Int. Cl.

| | |
|---|---|
| ***H01F 1/24*** | (2006.01) |
| ***H01F 17/00*** | (2006.01) |
| ***H01F 17/04*** | (2006.01) |
| *H01F 27/29* | (2006.01) |

(52) U.S. Cl.

CPC ..... *H01F 1/24* (2013.01); *H01F 17/0013* (2013.01); *H01F 17/04* (2013.01); *H01F 27/292* (2013.01); *H01F 2017/048* (2013.01)

(58) Field of Classification Search

CPC ..... H01F 1/24

See application file for complete search history.

(56) References Cited

U.S. PATENT DOCUMENTS

| | | | | |
|---|---|---|---|---|
| 6,432,159 | B1 * | 8/2002 | Saito | H01F 1/20 75/252 |
| 2008/0238601 | A1 * | 10/2008 | Das | H01F 1/24 336/200 |
| 2011/0285486 | A1 * | 11/2011 | Maeda | H01F 41/0246 335/297 |
| 2013/0249664 | A1 * | 9/2013 | Tonoyama | H01F 27/255 336/200 |
| 2013/0271256 | A1 * | 10/2013 | Ueno | H01F 41/0206 336/221 |
| 2013/0293334 | A1 * | 11/2013 | Shin | H01F 41/046 336/192 |

(Continued)

FOREIGN PATENT DOCUMENTS

| | | | |
|---|---|---|---|
| CN | 102292177 | A | 12/2011 |
| JP | 2001-250709 | A | 9/2001 |

(Continued)

*Primary Examiner* — Elvin G Enad
*Assistant Examiner* — Malcolm Barnes
(74) *Attorney, Agent, or Firm* — Oliff PLC

(57) ABSTRACT

In a coil component (planar coil element), at least part of a third metal magnetic powder constituting a metal magnetic powder and having a minimum average grain diameter is uncoated, which suppresses a reduction in magnetic permeability. On the other hand, the remaining metal powders are coated with glass, which improves the insulating properties of a metal magnetic powder-containing resin and reduces core loss.

8 Claims, 8 Drawing Sheets

(56) References Cited

U.S. PATENT DOCUMENTS

| | | | | |
|---|---|---|---|---|
| 2014/0077914 | A1 | 3/2014 | Ohkubo et al. | |
| 2014/0132387 | A1* | 5/2014 | Shin | H01F 27/2804 336/200 |
| 2014/0266543 | A1 | 9/2014 | Park et al. | |
| 2014/0286814 | A1* | 9/2014 | Kotani | H01F 41/0246 419/30 |
| 2015/0002255 | A1* | 1/2015 | Kim | H01F 27/255 336/233 |
| 2015/0235753 | A1* | 8/2015 | Chatani | H01F 27/245 336/200 |
| 2017/0053729 | A1* | 2/2017 | Kotani | H01F 1/24 |

FOREIGN PATENT DOCUMENTS

| | | | |
|---|---|---|---|
| JP | 2014-060284 | A | 4/2014 |
| JP | 2014-183307 | A | 9/2014 |
| KR | 2011-0099717 | A | 9/2011 |
| WO | 2013/073180 | A1 | 5/2013 |

* cited by examiner

COIL COMPONENT WITH COVERING RESIN HAVING MULTIPLE KINDS OF METAL POWDERS

CROSS-REFERENCE TO RELATED APPLICATIONS

This application is based upon and claims the benefit of priority from Japanese Patent Application No. 2014-241984, filed on Nov. 28, 2014, the entire contents of which are incorporated herein by reference.

TECHNICAL FIELD

The present invention relates to a coil component.

BACKGROUND

Coil components such as surface mount-type planar coil elements are conventionally used in various electrical products such as household devices and industrial devices. In particular, small portable devices have come to be required to obtain two or more voltages from a single power source to drive individual devices due to enhanced functions. Therefore, surface mount-type planar coil elements are used also as power sources to satisfy such a requirement.

One of such coil components is disclosed in, for example, Japanese Unexamined Patent Publication No. 2014-60284. The coil component disclosed in this document comprises a coil conductor and a metal magnetic powder-containing resin covering the coil conductor, and the metal magnetic powder-containing resin contains three kinds of metal powders different in average grain diameter (first, second, and third magnetic powders). Such a coil component can have improved magnetic permeability due to a reduction in the distance between metal powder grains achieved by the second magnetic powder having a medium grain diameter.

SUMMARY

In order to further enhance the insulating properties of an element body of the coil component or further reduce the core loss of the coil component, the metal powders may be covered with an insulating coating. In this case, however, magnetic permeability is reduced due to a reduction in magnetic flux density.

In order to solve the above problem, it is an object of the present invention to provide a coil component that comprises a metal magnetic powder-containing resin having improved insulation properties and that achieves a reduction in core loss while suppressing a reduction in magnetic permeability.

A coil component according to one aspect of the present invention comprises: a coil unit including a substrate and a conductor pattern for planar coil provided on the substrate; and a metal magnetic powder-containing resin covering the coil unit, wherein the metal magnetic powder-containing resin contains three or more kinds of metal powders different in average grain diameter, and wherein, out of the metal powders contained in the metal magnetic powder-containing resin, at least part of the metal powder having a minimum average grain diameter is not covered with an insulating coating, and the remaining metal powders are covered with an insulating coating.

In such a coil component, out of the three or more kinds of metal powders different in average grain diameter contained in the metal magnetic powder-containing resin, at least part of the metal powder having a minimum average grain diameter is not covered with an insulating coating. The present inventors have newly found that the metal powder having a minimum average grain diameter greatly influences magnetic permeability, and a reduction in magnetic permeability is suppressed by not covering at least part of the metal powder having a minimum average grain diameter with an insulating coating. On the other hand, the remaining metal powders are covered with an insulating coating, which improves the insulating properties of the metal magnetic powder-containing resin and reduces the core loss of the coil.

Further, the metal powder having a minimum average grain diameter may comprise two or more kinds of metal powders different in constituent material.

Further, the metal powder having a minimum average grain diameter may comprise an Fe powder and an Ni powder. Further, the Ni powder constituting the metal powder having a minimum average grain diameter may be covered with an insulating coating.

Further, the insulating coating covering the remaining metal powders may be a glass coating.

Further, the metal powders contained in the metal magnetic powder-containing resin may be three kinds of metal powders different in average grain diameter.

According to one aspect of the present invention, it is possible to provide a coil component that comprises a metal magnetic powder-containing resin having improved insulation properties and that achieves a reduction in core loss while suppressing a reduction in magnetic permeability.

DETAILED DESCRIPTION

Figure 1:
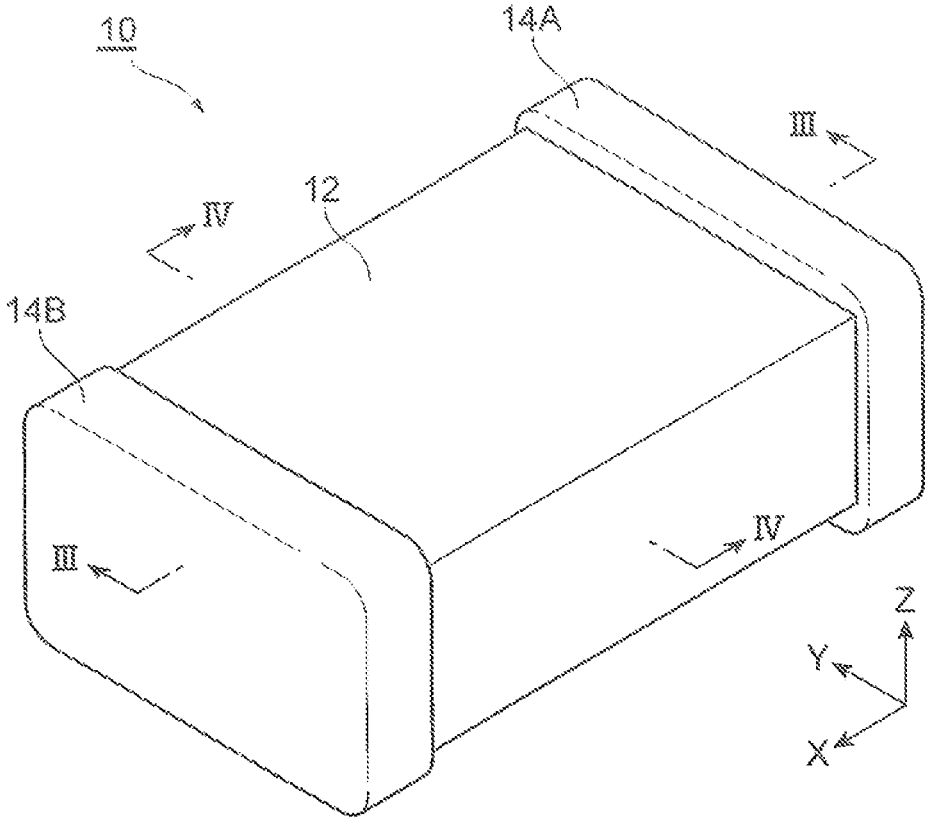
FIG. 1 is a schematic perspective view of a planar coil element according to an embodiment of the present invention.
Figure 2:
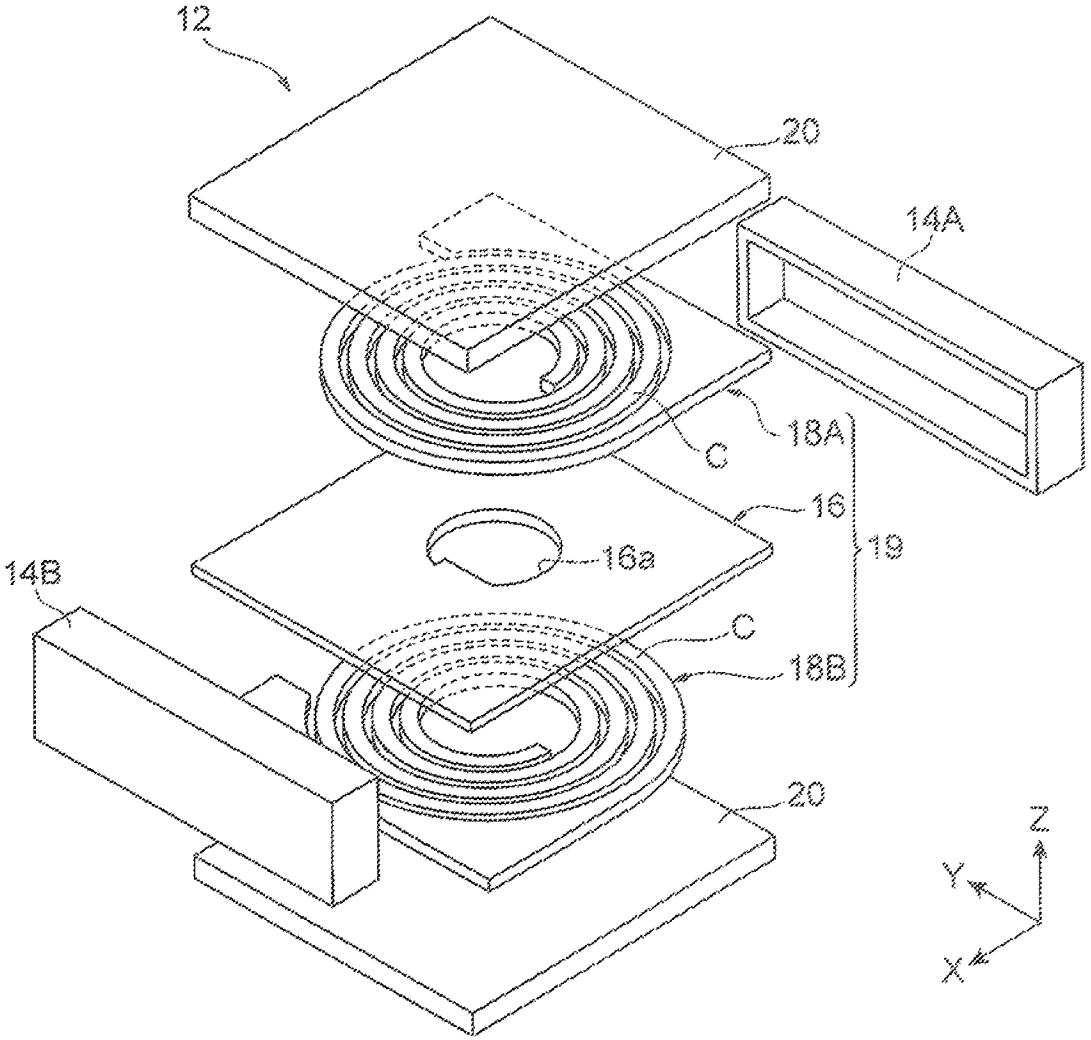
FIG. 2 is an exploded view of the planar coil element shown in FIG. 1.
Figure 3:
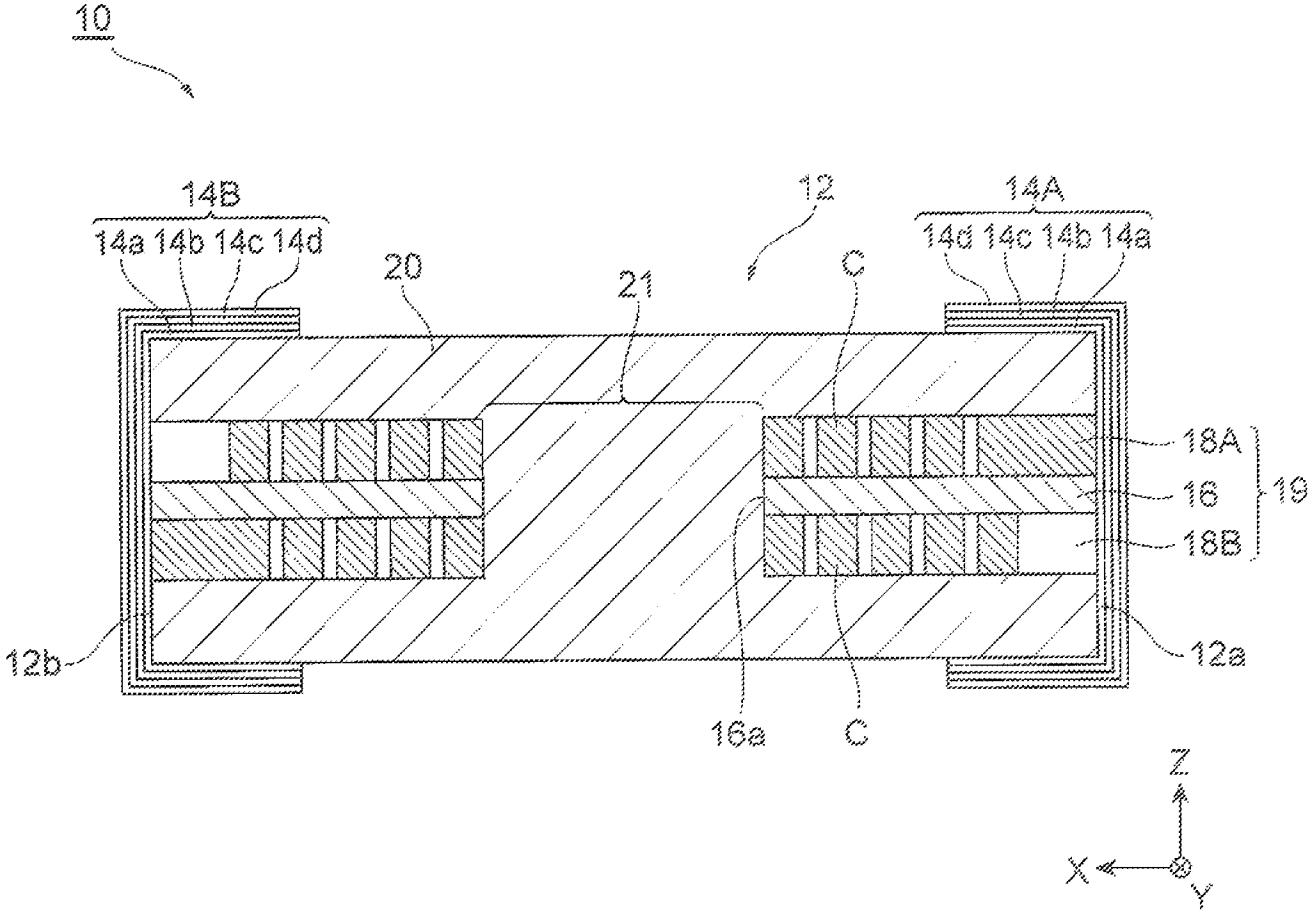
FIG. 3 is a sectional view of the planar coil element taken along a line in FIG. 1.
Figure 4:
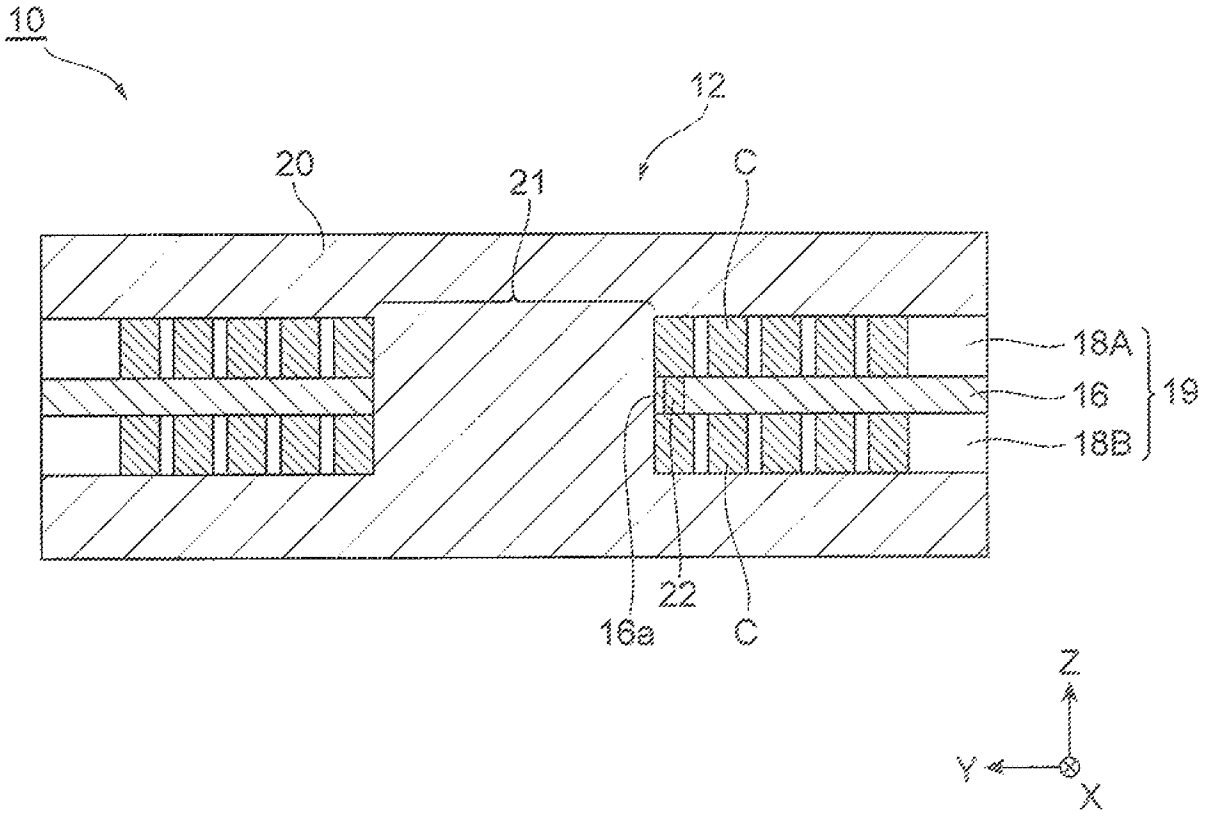
FIG. 4 is a sectional view of the planar coil element taken along a line Iv-Iv in FIG. 1.

Hereinbelow, a preferred embodiment of the present invention will be described in detail with reference to the accompanying drawings. It is to be noted that in the following description, the same elements or elements having the same function are represented by the same reference numerals, and description thereof will not be repeated.

First, the structure of a planar coil element that is a kind of coil component according to an embodiment of the present invention will be described with reference to FIGS. 1 to 4. For convenience of description, as shown in the drawings, X-, Y-, and Z-coordinates are set. More specifically, the thickness direction of the planar coil element is defined as a Z direction, a direction in which external terminal electrodes are opposed to each other is defined as an X direction, and a direction orthogonal to the Z direction and the X direction is defined as a Y direction.

A planar coil element 10 includes a main body 12 having a rectangular parallelepiped shape and a pair of external terminal electrodes 14A and 14B provided to cover a pair of opposing end faces 12*a* and 12*b* of the main body 12. The planar coil element 10 is designed to have, for example, a long side of 2.5 mm, a short side of 2.0 mm, and a height of 0.8 to 1.0 mm.

The main body 12 has a coil unit 19 having a substrate 16 and conductor patterns 18A and 18B for planar air core coil which are provided on both upper and lower sides of the substrate 16.

The substrate 16 is a plate-like rectangular member made of a non-magnetic insulating material. In the central part of the substrate 16, an approximately-circular opening 16*a* is provided. As the substrate 16, a substrate can be used which is obtained by impregnating a glass cloth with a cyanate resin (BT (bismaleimide triazine) resin: trademark) and has a thickness of 60 μm. It is to be noted that polyimide, aramid, or the like may be used instead of BT resin. As a material of the substrate 16, ceramics or glass may also be used. Preferred examples of the material of the substrate 16 include mass-produced printed circuit board materials, and particularly, resin materials used for BT printed circuit boards, FR4 printed circuit boards, or FR5 printed circuit boards are most preferred.

Both the conductor patterns 18A and 18B are planar spiral patterns constituting a planar air core coil and are formed by plating with a conductive material such as Cu. It is to be noted that the surfaces of the conductor patterns 18A and 18B are coated with an insulating resin (not shown). A winding wire C of the conductor patterns 18A and 18B has, for example, a height of 80 to 260 μm, a width of 40 to 260 μm, and a winding pitch of 5 to 30 μm.

The conductor pattern 18A is provided on the upper surface of the substrate 16, and the conductor pattern 18B is provided on the lower surface of the substrate 16. The conductor patterns 18A and 18B are almost superimposed with the substrate 16 being interposed therebetween, and both of them are provided to surround the opening 16*a* of the substrate 16. Therefore, a through hole (magnetic core 21) is provided in the coil unit 19 by the opening 16*a* of the substrate 16 and the air cores of the conductor patterns 18A and 18B.

The conductor pattern 18A and the conductor pattern 18B are electrically connected to each other by a via-hole conductor 22 provided to penetrate through the substrate 16 near the magnetic core 21 (i.e., near the opening 16*a*). Further, the conductor pattern 18A provided on the upper surface of the substrate spirals outwardly in a counterclockwise direction when viewed from the upper surface side, and the conductor pattern 18B provided on the lower surface of the substrate spirals outwardly in a counterclockwise direction when viewed from the lower surface side, which makes it possible to pass an electrical current through the conductor patterns 18A and 18B connected by the via-hole conductor 22 in a single direction. When an electrical current is passed through the conductor patterns 18A and 18B in a single direction, a direction in which the electrical current passing through the conductor pattern 18A rotates and a direction in which the electrical current passing through the conductor pattern 18B rotates are the same, and therefore magnetic fluxes generated by both the conductor patterns 18A and 18B are superimposed and enhance each other.

Further, the main body 12 has a metal magnetic powder-containing resin 20 enclosing the coil unit 19. As a resin material of the metal magnetic powder-containing resin 20, for example, a thermosetting epoxy resin is used. The metal magnetic powder-containing resin 20 integrally covers the conductor pattern 18A and the upper surface of the substrate 16 on the upper side of the coil unit 19 and integrally covers the conductor pattern 18B and the lower surface of the substrate 16 on the lower side of the coil unit 19. Further, the metal magnetic powder-containing resin 20 also fills the through hole provided in the coil unit 19 as the magnetic core 21.

Figure 5:
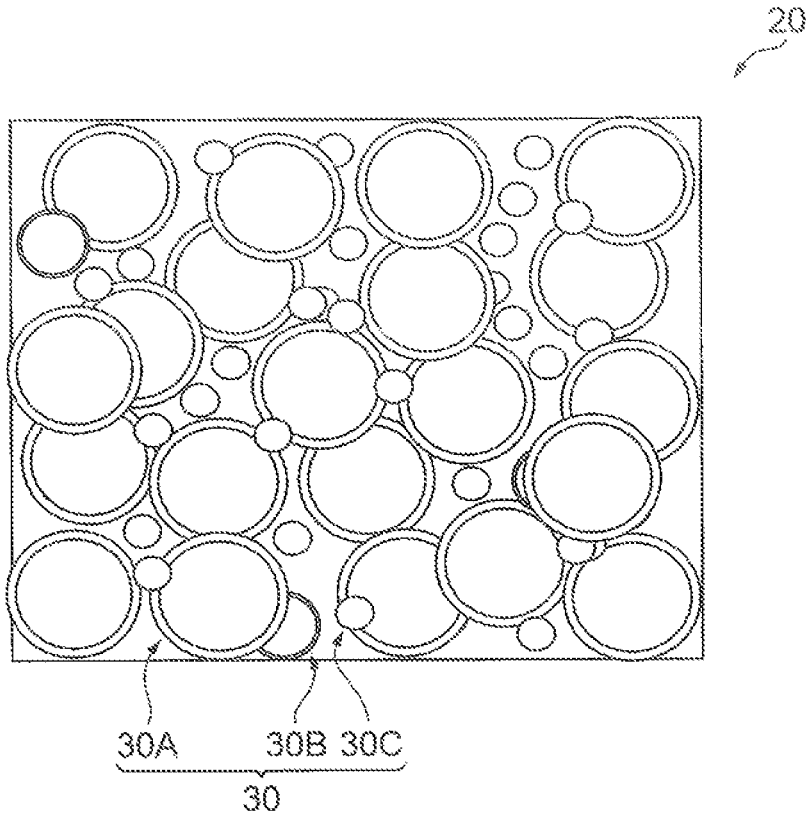
FIG. 5 is a diagram illustrating the state of metal magnetic powders contained in a resin constituting the planar coil element shown in FIG. 1.

As shown in FIG. 5, three kinds of metal magnetic powders 30A, 30B, and 30C different in average grain diameter are dispersed in the metal magnetic powder-containing resin 20. For convenience of description, the metal magnetic powder having a maximum average grain diameter, the metal magnetic powder having a medium average grain diameter, and the metal magnetic powder having a minimum average grain diameter are hereinafter referred to as a first metal magnetic powder 30A, a second metal magnetic powder 30B, and a third metal magnetic powder 30C, respectively.

Figure 6A:
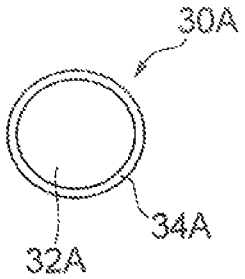
FIGS. 6A, 6B, and 6C are diagrams illustrating the three kinds of metal magnetic powders differing in average grain diameter.

As shown in FIG. 6A, the first metal magnetic powder 30A comprises a powder 32A and a glass coating 34A covering the surface of the powder 32A. The powder 32A is made of, for example, an Fe—Si—Cr alloy or an iron-nickel alloy (permalloy). The average grain diameter (D50: median diameter) of the first metal magnetic powder 30A is, for example, 30 μm, preferably in the range of 10 to 100 μm. The metal magnetic powder-containing resin 20 is designed so that the amount of the first metal magnetic powder 30A contained therein is in the range of 60 to 80 wt %.

Figure 6B:
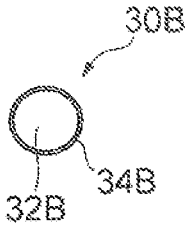

Similarly to the first metal magnetic powder 30A, as shown in FIG. 6B, the second metal magnetic powder 30B also comprises a powder 32B and a glass coating 34B covering the surface of the powder 32B. The powder 32B is made of, for example, an Fe—Si—Cr alloy or iron (carbonyl iron). The average grain diameter (D50) of the second metal magnetic powder 30B is, for example, 3 μm, preferably in the range of 1 to 10 μm. The metal magnetic powder-containing resin 20 is designed so that the amount of the second metal magnetic powder 30B contained therein is in the range of 5 to 20 wt %.

Figure 6C:
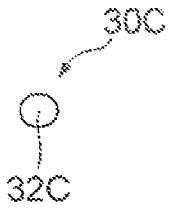

As shown in FIG. 6C, the third metal magnetic powder 30C contains an uncoated powder 32C. The powder 32C is made of, for example, iron (carbonyl iron). In this embodiment, the third metal magnetic powder 30C further contains an Ni powder coated with glass as in the case of the first metal magnetic powder 30A and the second metal magnetic powder 30B. The average grain diameter (D50) of the third metal magnetic powder 30C is, for example, 1 μm, preferably in the range of 0.3 to 3 μm. The metal magnetic powder-containing resin 20 is designed so that the amount of the third metal magnetic powder 30C contained therein is in the range of 5 to 20 wt %.

It is to be noted that the metal magnetic powder-containing resin 20 is designed so that the mixing ratio by weight among the first metal magnetic powder 30A, the second metal magnetic powder 30B, and the third metal magnetic powder 30C is 6:1:1.

The pair of external terminal electrodes 14A and 14B are provided to connect the element to the circuit of a substrate on which the element is to be mounted, and are connected to the conductor patterns 18A and 18B. More specifically, the external terminal electrode 14A that covers the end face 12*a* of the main body 12 is connected to the end of the conductor pattern 18A exposed at the end face 12*a*, and the external terminal electrode 14B that covers the end face 12*b* opposed to the end face 12*a* is connected to the end of the conductor pattern 18B exposed at the end face 12*b*. Therefore, when a voltage is applied between the external terminal electrodes 14A and 14B, for example, an electrical current flowing from the conductor pattern 18A to the conductor pattern 18B is generated.

In this embodiment, each of the external terminal electrodes 14A and 14B is formed by applying a resin electrode material onto the end faces and then coating the resin electrode material with metal plating. The metal plating used to form the external terminal electrodes 14A and 14B may be made of, for example, Cr, Cu, Ni, Sn, Au, or solder.

As described above, the metal magnetic powder-containing resin 20 of the planar coil element 10 contains the three or more kinds of metal powders 30A, 30B, and 30C different in average gran diameter. Part of the third metal magnetic powder 30C (i.e., the Fe powder) is not coated with glass, and the remaining metal magnetic powders (i.e., the first metal magnetic powder 30A, the second metal magnetic powder 30B, and the Ni powder contained in the third metal magnetic powder 30C) are coated with glass.

Figure 7:
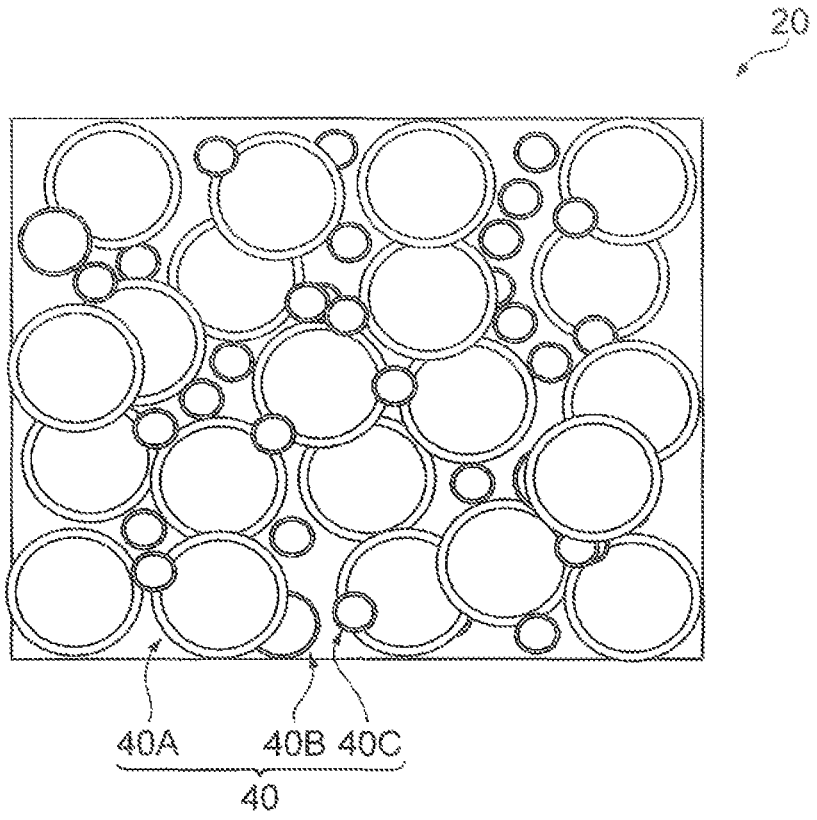
FIG. 7 is a diagram illustrating the state of metal magnetic powders coated with glass.
Figure 8:
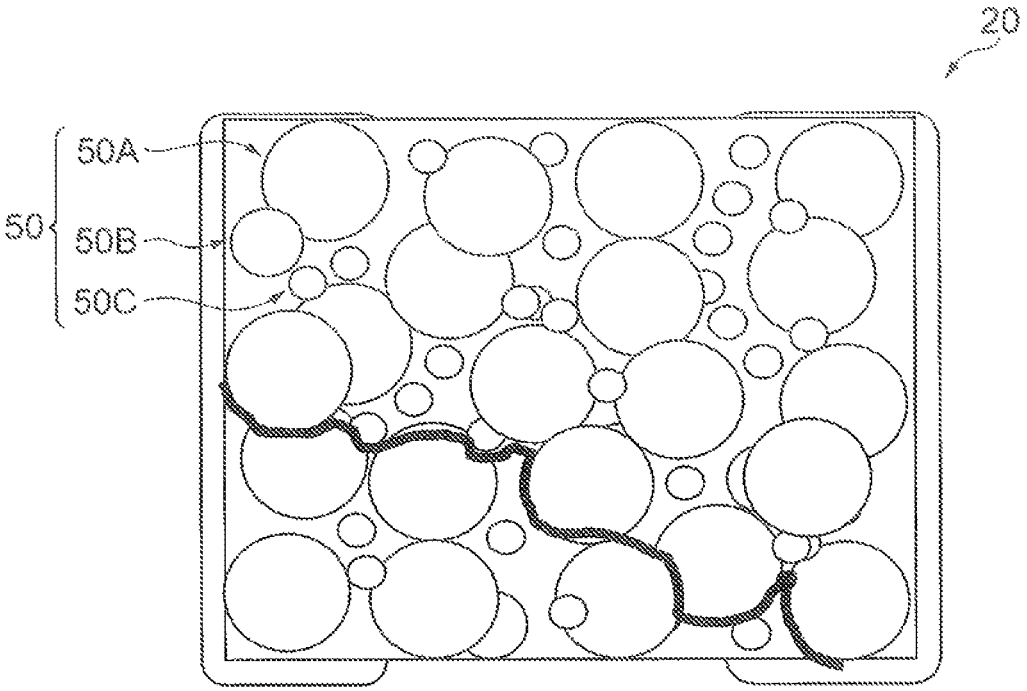
FIG. 8 is a diagram illustrating the state of metal magnetic powders not coated with glass.

FIG. 7 shows a metal magnetic powder 40 contained in the metal magnetic powder-containing resin 20 and comprising three kinds of metal magnetic powders 40A, 40B, and 40C different in average grain diameter, wherein all the metal magnetic powders are coated with glass. FIG. 8 shows a metal magnetic powder 50 contained in the metal magnetic powder-containing resin 20 and comprising three kinds of metal magnetic powders 50A, 50B, and 50C different in average grain diameter, wherein none of the metal magnetic powders is coated with glass.

The metal magnetic powder 40 shown in FIG. 7 can improve the insulating properties of the resin 20 (element body) and reduce the core loss of the coil unit 19 as compared to the metal magnetic powder 50 shown in FIG. 8 due to the glass coating covering the surface of each of the metal magnetic powders 40A, 40B, and 40C. On the other hand, as shown in FIG. 8, the metal magnetic powder 50 reduces the insulating properties of the resin 20 (element body) because a conductive path is easily formed by contact between grains of the metal magnetic powders.

However, the metal magnetic powder 40 shown in FIG. 7 reduces magnetic permeability as compared to the metal magnetic powder 50 shown in FIG. 8 due to the glass coating covering the surface of each of the metal magnetic powders 40A, 40B, and 40C. The third metal magnetic powder 40C contained in the metal magnetic powder 40 and having a minimum average grain diameter greatly influences magnetic permeability. The reason for a reduction in magnetic permeability is considered to be that such a metal magnetic powder 40C is coated with glass.

As shown in FIGS. 5, 6A, 6B, and 6C, the present inventors have newly found that a reduction in magnetic permeability is suppressed when at least part of the third metal magnetic powder 30C contained in the metal magnetic powder 30 and having a minimum average grain diameter selectively comprises the powder 32C not coated with glass.

That is, in the coil component (planar coil element) 10, at least part of the third metal magnetic powder 30C contained in the metal magnetic powder 30 and having a minimum average grain diameter is uncoated, which suppresses a reduction in magnetic permeability. On the other hand, the remaining metal powders are coated with glass, which improves the insulating properties of the metal magnetic powder-containing resin 20 and reduces the core loss of the coil.

Further, the metal magnetic powder 30C not coated with glass is small in size because its grain diameter is reduced by the absence of a glass coating, that is, its grain diameter does not include the thickness of a glass coating. Therefore, the metal magnetic powder 30C easily enters between grains of the first and second metal magnetic powders 30A and 30B having a larger diameter, and as a result, the filling rate of the metal magnetic powder can be improved.

It is to be noted that the present invention is not limited to the above-described embodiment, and various changes may be made.

For example, the constituent material of the first and second metal magnetic powders may be an amorphous metal, an FeSiCr-based alloy, or Sendust instead of an iron-nickel alloy (permalloy). Further, the third metal magnetic powder does not always need to comprise two or more kinds of metal powders different in constituent material, and may comprise one kind of metal powder (e.g., only Fe). In this case, the third metal magnetic powder may be provided by not covering the one kind of metal powder with an insulating coating at all or by not covering only part of the one kind of metal powder with an insulating coating.

Further, the insulating coating is not limited to a glass coating, and may be, for example, a resin coating. Further, the metal magnetic powder-containing resin is not limited to one containing three kinds of metal powders different in average grain diameter, and may be one containing four or more kinds of metal powders different in average grain diameter. Also in this case, the same functions and effects as those of the above-described embodiment can be obtained by not covering at least part of a metal powder having a minimum average grain diameter with an insulating coating.

What is claimed is:

1. A coil component comprising:

a coil unit including a substrate and a conductor pattern for planar coil provided on the substrate; and a metal magnetic powder-containing resin covering the coil unit, wherein:

the metal magnetic powder-containing resin contains three or more kinds of metal powders different in average grain diameter, the metal powders are made of pure metal or alloy and are held together by metallic bonds, out of the metal powders contained in the metal magnetic powder-containing resin, at least part of the metal powder having a minimum average grain diameter is not covered with a glass coating, and the remaining metal powders are covered with a glass coating, the metal powder having a minimum average grain diameter comprises two or more kinds of metal powders different in constituent material, and the two or more kinds of metal powder include an Fe powder and an Ni powder.

2. The coil component according to claim 1, wherein the Ni powder constituting the metal powder having a minimum average grain diameter is covered with a glass coating.

3. The coil component according to claim 1, wherein the metal powders contained in the metal magnetic powder-containing resin are three kinds of metal powders different in average grain diameter.

4. A coil component comprising:

a coil unit including a substrate and a conductor pattern for planar coil provided on the substrate; and a metal magnetic powder-containing resin covering the coil unit, wherein:

the metal magnetic powder-containing resin contains three or more kinds of metal powders different in average grain diameter, the metal powders are made of pure metal or alloy and are held together by metallic bonds, out of the metal powders contained in the metal magnetic powder-containing resin, at least part of the metal powder having a minimum average grain diameter is not covered with a resin coating, and the remaining metal powders are covered with a resin coating, the metal powder having a minimum average grain diameter comprises two or more kinds of metal powders different in constituent material, and the two or more kinds of metal powders include an Fe powder and an Ni powder.

5. The coil component according to claim 4, wherein the Ni powder constituting the metal powder having a minimum average grain diameter is covered with a resin coating.

6. The coil component according to claim 4, wherein the metal powders contained in the metal magnetic powder-containing resin are three kinds of metal powders different in average grain diameter.

7. The coil component according to claim 1, wherein a part of the metal powder having a minimum average grain diameter is covered with a glass coating.

8. The coil component according to claim 4, wherein a part of the metal powder having a minimum average grain diameter is covered with a resin coating.

* * * * *